United States Patent [19]

Reynolds

[11] 4,207,801

[45] Jun. 17, 1980

[54] HYDRAULIC OSCILLATORY DEVICES

[75] Inventor: Lionel A. Reynolds, Stroud, England

[73] Assignee: A. F. Hydraulics Limited, Chequers Bridge, England

[21] Appl. No.: 849,719

[22] Filed: Nov. 8, 1977

Related U.S. Application Data

[63] Continuation of Ser. No. 626,556, Oct. 28, 1975, abandoned.

[30] Foreign Application Priority Data

Nov. 14, 1974 [GB] United Kingdom ..... 49232/74

[51] Int. Cl.[2] ..... F01L 25/06; F01B 7/18

[52] U.S. Cl. ..... 91/278; 91/300; 91/321; 92/108

[58] Field of Search ..... 91/278, 321, 300

[56] References Cited

U.S. PATENT DOCUMENTS

| | | | |
|---|---|---|---|
| 3,552,269 | 1/1971 | Arndt | 91/278 |
| 3,780,621 | 12/1973 | Romell | 91/278 |

*Primary Examiner*—Paul E. Maslousky

*Attorney, Agent, or Firm*—Cushman, Darby & Cushman

[57] ABSTRACT

A hydraulically-operated road breaker comprises a casing with a tool mounting and housing an oscillatory piston/striker and cylinder arrangement. A sequence valve mounted in the casing controls pressurization and exhausting of the piston to produce power and return strokes of the piston. Pilot port means positioned in the cylinder of the device are uncovered, at the end of each return stroke of the piston, to allow a valve-actuating flow of hydraulic fluid through the port means to change over the sequence valve and thereby cause stroke reversal of the piston. Manually-operable stroke selection means provide for adjustment of the position of the piston in the cylinder at which the valve-actuating flow occurs, whereby to vary the piston stroke.

4 Claims, 6 Drawing Figures

HYDRAULIC OSCILLATORY DEVICES

This is a continuation of application Ser. No. 626,556 filed Oct. 28, 1975, now abandoned.

BACKGROUND OF THE INVENTION

This invention relates to hydraulically-operated oscillatory devices, and particularly but not exclusively to percussive devices of the type embodying a reciprocatory piston/striker and cylinder arrangement with a sequence valve operated by a pilot port controlled by the piston/striker itself to limit the piston stroke.

In our U.S. Pat. No. 3,887,019 we have described such a device which, for efficient and satisfactory operation, has to be matched to the hydraulic power supply in terms of pressure and volume flow. There is a requirement for percussive devices, for example a light portable hammer, which can selectively be operated with either short high-speed strokes of low energy or long and relatively low-speed strokes of relatively high energy, but the problem is to design such a device which will be satisfactorily matched to the same power source in each operating condition.

SUMMARY OF THE INVENTION

The object of the invention is to overcome the foregoing problem, and to this end the invention provides an oscillatory device which can be supplied from a constant power source and operates with short high-speed strokes or with long relatively low-speed strokes of relatively high power.

According to the invention a hydraulically-operated oscillatory device comprises an oscillatory piston and cylinder arrangement, a sequence valve which controls pressurization and exhausting of the piston, pilot port means positioned in the cylinder so as to be uncovered by the piston to allow a valve-actuating flow of hydraulic fluid through the port means to change over the sequence valve and thereby cause stroke reversal of the piston, and stroke selection means whereby the position of the piston in the cylinder at which the valve-actuating flow occurs through the pilot port means can be changed to vary the piston stroke.

Said pilot port means may comprise a plurality of separate ports with said stroke selection means comprising valve means whereby the ports are selectively and individually rendered operative. Thus in a two-speed percussive device said pilot port means may comprise two separate ports with said stroke selection valve comprising a single ON/OFF valve controlling the separate port first uncovered by the piston on the return stroke connected to a pilot operating piston of the sequence valve. An arrangement is provided in which the product of operating speed and blow energy is substantially constant, thus allowing a constant output power source to be used for both high- and low-speed working and to be accurately matched to the implement in both these operating conditions.

The stroke selection valve means may alternatively comprise a sleeve valve mounted within the cylinder, this being preferable in a multi-speed percussive device having more than two pilot ports selectively operable for termination of the return piston stroke. A valve member of the sleeve valve may provide at least a portion of the piston bore, and the sleeve valve is preferably of rotary type with the pilot port means comprising a plurality of separate ports in one member of the sleeve valve and a cooperating single port in another coaxial member of the sleeve valve. In this case one of the sleeve valve members is preferably selectively adjustable for stroke selection, and although the outer sleeve valve member may be provided by a fixed casing of the device both of the sleeve valve members may be separate from and mounted within the casing.

Instead of the stroke selection means comprising valve means controlling the pilot port means, a single pilot port of the latter may be adjustably controlled in terms of piston position by an inclined edge of a land on the piston by which this single pilot port means is uncovered. In this case said stroke selection means are operable to turn the piston within the cylinder and to restrain the piston to reciprocate in the selected angular position. In order to provide a hydraulically balanced arrangement the land inclination is preferably duplicated diametrically of the piston, and then said single pilot port may be one of two similar, and interconnected, diametrically opposite pilot ports which further improves hydraulic balance and flow conditions.

Other features of the invention will be apparent from the following description, drawings and claims, the scope of the invention not being limited to the drawings themselves as the drawings are only for the purpose of illustrating a way in which the principles of the invention can be applied. Other embodiments of the invention, utilizing the same or equivalent principles may be used and structural changes may be made as desired by those skilled in the art without departing from the present invention and the purview of the appended claims.

DESCRIPTION OF THE PREFERRED EMBODIMENT

Figure 1:
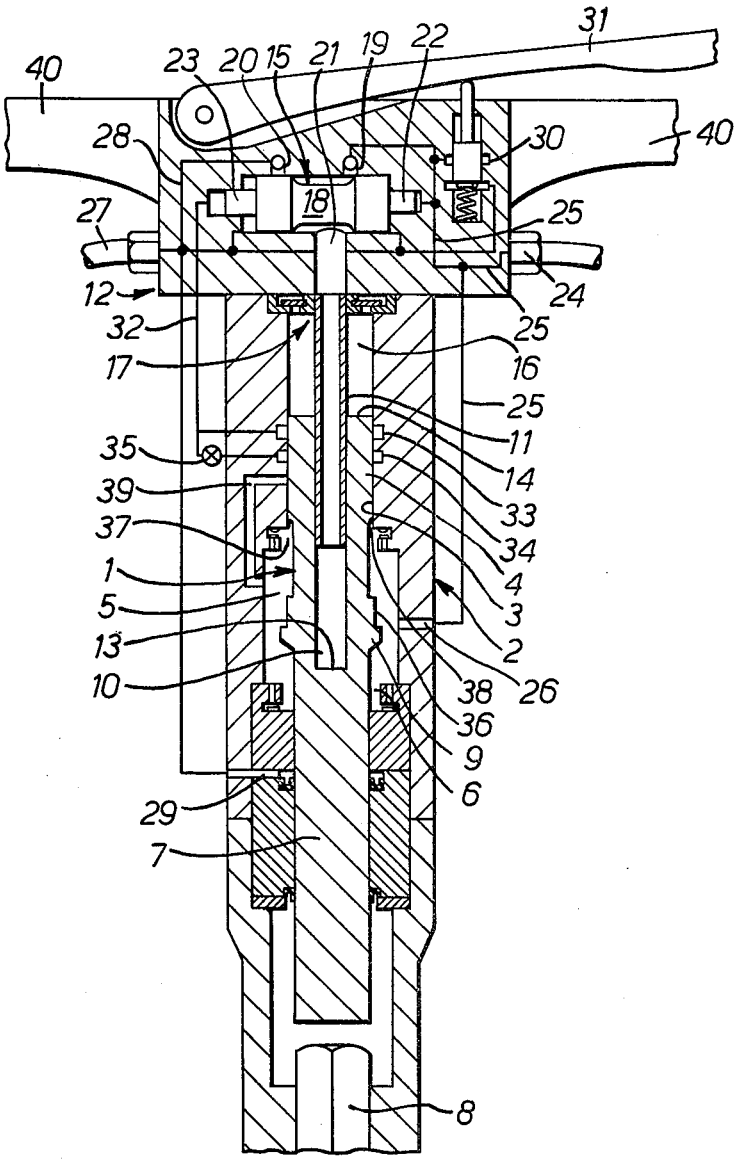
FIG. 1 is an axial sectional view of a road-breaking hammer in accordance with the invention, with various integral conduits illustrated diagrammatically in the manner of a circuit diagram.

The hammer illustrated in FIG. 1 is a modified version of one of the embodiment described in our U.S. Pat. No. 3,887,019, the modification introducing the features of the present invention.

An integral striker/piston member 1 is reciprocable in a casing 2, which has a cylinder bore 3 in which a piston head 4 of the member 1 is a sliding fit. The casing has a chamber 5 with a dashpot cavity 6 of reduced diameter at its lower end, i.e. the end adjacent the tool-receiving end of the hammer. A lower striker portion 7 of the striker/piston member 1 directly impacts a tool 8, only the upper end of which is shown, during operation of the hammer. An enlarged area portion of the member 1 which enters the cavity 6 at the end of a working stroke to damp overtravel of that member is provided by an integral collar 9.

The piston head 4 is bored out at 10 to receive a tube 11 anchored to the upper end of the casing 2 and held in position by a casing head 12. The lower end wall 13 of the bore 10 constitutes the effective piston working area. The upper annular end face 14 of the piston head 4 may be regarded as an idle annulus so far as the execution of working and return piston strokes is concerned. It is nevertheless harnessed to a useful function, in connection with the operation of a pilot-operated sequence valve 15 which controls the pressurisation and exhausting of the piston.

At the top of the chamber 16 surrounding the tube 11 there is a one-way valve assembly 17. The chamber 16 tends to receive a small amount of leakage fluid from the chamber 5 past the piston head 4, and from the bore 10 past the tube 11. This is expelled through the one-way valve 17 when the piston head 4 rises during the return piston strokes. When the striker/piston member 1 descends the valve 17 closes and a partial vacuum is formed in the chamber 16.

The valve 15 and its mode of operation will now be described. A two-land spool 18 is slidable in a bore having two side ports 19 and 20 and a central port 21 leading to the bore 10, which provides the hydraulic working chamber, through the tube 11. The end of the spool 18 nearest to the port 19 has a pilot piston portion 22 and the other end of the spool 18 has a larger diameter pilot piston portion 23.

A high pressure fluid inlet connection 24 is connected via a conduit 25 to a port 26 leading to the chamber 5, and is also connected to the valve port 19 and the pilot piston 22. A low pressure fluid exhaust connection 27 is connected, via a conduit 28, to the port 20 and to a leakage recovery port 29 associated with sealing means for the chamber 5 through which the striker portion 7 passes. The conduits 25 and 28 are connected to a stop-start valve 30 operated by a hand lever 31 pivoted on the casing head 12. When the implement is operating the high pressure fluid bears constantly upon the end face of the pilot piston 22.

The larger diameter pilot piston 23 is connected via a conduit 32 to a pilot port 33 in the wall of the bore 3 at a position such that it is cleared by the end face 14 of the piston head 4 when the latter approaches the lower end of its working stroke. This signals exhaust and places the pilot piston 23 in communication with the chamber 16 which is then at low pressure so that the spool 18 moves to the left, driven by the high pressure acting on the pilot piston 22, to put the chamber 10 into communication with the low pressure connection 27. In this condition the neck of the spool 18 bridges the ports 20 and 21, with the port 19 closed off. The striker/piston member 1 then rises under the hydraulic supply pressure in the chamber part 5 acting on the effective return piston area.

In accordance with the invention the port 33 is one of two pilot ports in the wall of the bore 3, a second port 34 being provided closer to the tool-receiving end of the casing 2. This port 34 is connected to the conduit 32 through an ON/OFF auxiliary control valve 35 which, in the open position, renders the port 34 operative to provide shorter working strokes of the striker/piston member 1 without changing the terminal cut-off point of the working strokes. The valve 35 is illustrated only diagrammatically in the drawings and is suitably positioned for external manual operation according to the stroke selection desired.

An upper dashpot is provided, operative to damp overtravel of the striker/piston member 1 when working in the long-stroke condition, although if desired this upper dashpot may be omitted. Above the collar 9 the diameter of the striker/piston member 1 is enlarged at 36 for a short distance, to the same diameter as that of the bore 3. An upper dashpot cavity 37 is provided at the top of the chamber 5, and this is entered by the collar 9 towards the end of the long recuperation return strokes.

The port 33, in the long-stroking condition with the valve 35 closed, is exposed to the high pressure in the chamber 5 when the member 1 reaches (or closely approaches) the upper end of a long return stroke and an annular lower edge 38 of the piston head 4 reaches the port 33. This edge 38 may be said to delimit the return piston area but its annular area is not necessarily equal to that area since the member 1 is preferably necked in immediately below the edge 38 to improve fluid flow conditions. The actual dimensions of the effective return piston area are determined by the difference between the cross-sectional areas of the piston head 4 and the striker portion 7.

The enlargement 36 enters the bore 3 to seal off the dashpot cavity 37 just before the edge 38 reaches the port 33, and a by-pass passage 39 is provided to ensure that fluid from the chamber 5 can reach the port 33 when the edge 38 reaches it. The enlargement 36 prevents the escape of fluid, trapped in the dashpot cavity 37 when entered by the collar 9, from escaping via the passage 39 when the port 33 has been uncovered by edge 38.

When the edge 38 of the piston head 4 passes the port 33 to uncover the latter, via the passage 39, the high pressure within the chamber 5 provides a force acting on the pilot piston 23 which, by reason of the larger diameter of the latter, overrides the force acting on the pilot piston 22, so that the spool 18 is driven to the right. This closes off the port 20 and bridges the ports 19 and 21 to apply the pressure from connection 24 to the chamber 10. Since the piston working area 13 is substantially larger than the return piston area, the member 1 is now forced downwards upon tool 8 to execute a working stroke. As soon as the edge 38 of piston head 4 has passed over the port 33, the pilot piston 23 is isolated and the valve means hydraulically locked with the spool 18 held over to the right until the piston face 14 uncovers the port 33, enabling the cavity containing the pilot piston 23 to discharge into the chamber 16 which is at this time below atmospheric pressure. The spool 18 then again moves to the left.

The fluid displaced by the pilot piston 23 into the chamber 16 is discharged, with other fluid leaking into that chamber, to the low pressure connection 27 via the valve 17 and the conduit 28, on the up-stroke of the striker/piston member 1.

With the valve 35 closed the port 34 is isolated and thus has no effect on operation of the hammer when it is uncovered by the edge 38 of piston head 4. However, when the valve 35 is moved to the open position to select the short working stroke condition the port 34 becomes operative to control the valve 18 in the manner already described in connection with the port 33. Thus the striker/piston member 1 executes shorter working strokes, the difference being determined by the spacing between the ports 33 and 34 in the bore 3.

The arrangement is such that whether operating with long strokes at relatively low speed or short strokes at relatively high speed the product of operating speed and blow energy remains substantially constant. Thus, a constant output power source of fixed pressure/flow characteristics can be used for both high and low speed working while remaining accurately matched to the power requirements of the hammer in both the operating conditions.

The spool of the ON/OFF valve 30 is spring-loaded upwardly to a position in which it uncovers a port connected to the conduit 25 and places it in communication with another port connected to the conduit 28, so that the high pressure fluid is short-circuited to the low pressure connection 27. The implement is thus rendered inoperative when the handle 31 is released. The handle 31 rests above one of the main handles 40 of the hammer and is automatically lowered on grasping that main handle, to force the spool of the ON/OFF valve 30 downwards to the position shown in the drawings. In this position the port connected to the high pressure connection 24 is closed off, and the hammer operates.

FIGS. 2 to 5 respectively illustrate diagrammatically four modifications in which said stroke selection means comprises a rotary sleeve valve. This sleeve valve is positioned in the casing 2 of the device and provides the pilot ports thereof, only a portion of the device in the region of the pilot ports being shown in these figures. Apart from the stroke selection control the device still operates as described with reference to FIG. 1 and the basic construction is still as shown in that figure.

Figure 2:
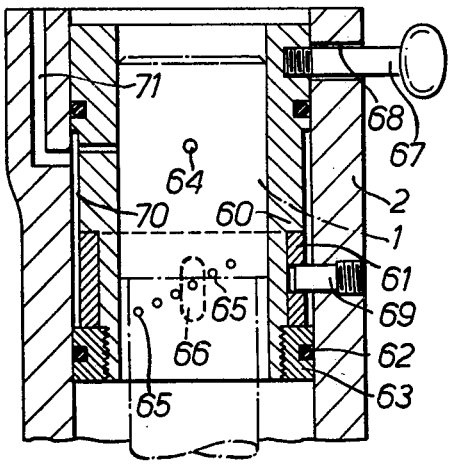
FIGS. 2 to 6 are detail sectional views illustrating the various modifications somewhat diagrammatically.

In the modification of FIG. 2 a sleeve valve mounted within the casing 2 provides the bore for the piston member 1 and comprises an inner rotary sleeve valve member 60 and an outer fixed sleeve valve member 61. The sleeve valve is sealed to the casing 2 by O rings 62 and the valve member 61 is axially located relatively to the member 60 in a peripheral recess in the latter, one end of the recess being provided by a seal ring 63 screwed on to the valve member 60 at the lower end thereof.

The valve member 60 has a single pilot port 64 which signals exhaust at the end of a power stroke of the piston 4, and, pilot port means for selective stroke control comprise six pilot ports 65 which are helically spaced in the valve member 60. A single axially elongated port 66 is provided in the outer valve member 61 and, as can be seen from FIG. 2, which one of the inner ports 65 communicates with the outer port 66 depends on the relative angular position of the valve memers 60 and 61, and hence any one of six available speeds can be selected by appropriate angular adjustment of the valve member 60 within the casing 2.

A stroke setting lever 67 is screwed into the valve member 60 and is movable, for stroke selection, along an arcuate slot 68 through the wall of the casing 2. A locating peg 69 screwed into the casing 2 projects inwardly thereof for engagement with the outer valve member 61 and angularly locates that valve member. The sleeve valve is cut away to provide an annular clearance 70 with respect to the casing 2 and with which the ports 64 and 66 communicate. A pilot signal conduit 71, corresponding to the conduit 32 of FIG. 1, leads as before to the sequence valve 18 for controlling piston reciprocation.

Figure 3:
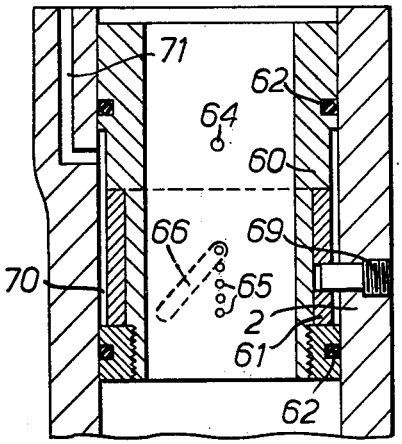

The arrangement of FIG. 3 is very similar to that of FIG. 2 and utilizes the same reference numerals. However, in this case the pilot port means for selective stroke control comprise an axially disposed row of ports 65 in the sleeve valve member 60 and these ports selectively communicate with a single helically inclined port 66 in the outer sleeve valve member 61.

Figure 4:
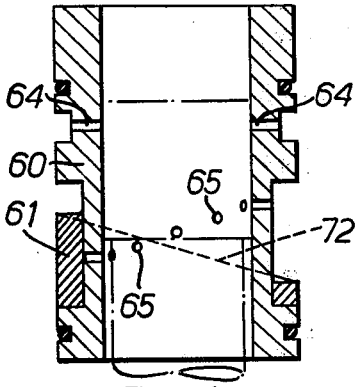

FIG. 4 illustrates a modified sleeve valve arrangement in which the inner sleeve valve member 60, provided with exhaust pilot port 64 and a helical row of stroke selection pilot ports 65, is angularly fixed within the casing 2 which is not shown in this figure. The outer sleeve valve member 61 is in this case angularly adjustable for stroke selection and it has an inclined edge 72 by which the ports 65 can be sequentially uncovered, starting with the port last uncovered.

Figure 5:
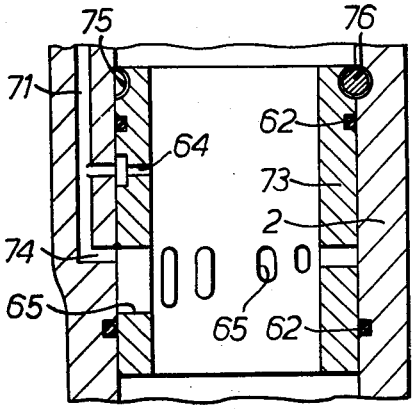

The modification of FIG. 5 employs a sleeve valve with a single sleeve member 75 which is a close fit in the casing 2 which, in effect, provides a cooperating valve member. The valve member 73 again provides the single exhaust pilot port 64 and a series of spaced stroke selection pilot ports 65. However, in this case the ports 65 are disposed in an arcuate series and are of differing lengths with their upper edges at the same level to provide selective communication with a port 74 in the casing 2, which port terminates the signal conduit 71. Due to the differing axial length of the ports 65 they are sequentially uncovered by the piston land, and it is the uncovering of the port 65 at the time communicating with the port 74 which signals the end of the piston return stroke.

FIG. 5 illustrates, by way of example, an alternative way of effecting rotary adjustment of the sleeve valve member 73 which is also applicable to the other arrangements. Adjacent its upper end the valve member 73 has a peripheral arcuate groove 75 which is milled, or otherwise formed, for meshing engagement with a worm screw 76 rotatably mounted in the casing 2 tangentially of the valve member 73. The screw 76 can be turned by an external adjustment knob (not shown), and this arrangement allows fine and more precise adjustment of the valve position associated with the irreversibility of a worm gear so that the valve sleeve 73 is precisely locked in any adjusted angular position. This locks the valve against any tendency to move under vibratory forces.

Figure 6:
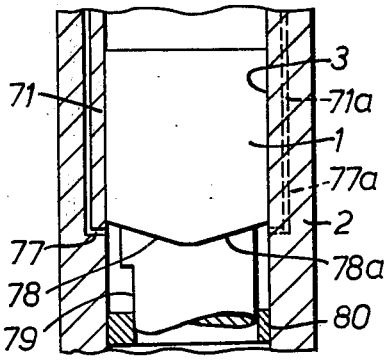

The final modification illustrated in FIG. 6 employs an entirely different method of effecting stroke selection by changing the angular position of the piston 1 within the cylinder provided by the bore 3 in the casing 2. In this case a single stroke selection port 77 terminates the conduit 71 and the piston 4 has a land, provided by the piston head, with an inclined edge 78 by which the pilot port 77 is uncovered. The stroke selection means are operable to turn the piston 1 within the cylinder bore 3 and to restrain the piston to reciprocate in the selected angular position. A typical example of how this may be achieved is illustrated. The reduced diameter portion of the piston 1 below the edge 78 is provided with a peripheral flat 79 and a rotary collar 80, the angular position of which is adjustable within the casing 2 and through which the piston extends, has a complementary internal profile. Thus the angular position of the collar 80, which is fixed in the casing 2 in the axial sense and in a practical construction is below the fixed seal through which the piston striker portion 7 extends (see FIG. 1), determines the adjusted angular position of the piston 4.

In order to provide a hydraulically balanced arrangement the inclination of the land 78 may be duplicated at **78*a* diametrically of the piston 4. With such diametral duplication of the land profile, a port 77*a* identical with and diametrically opposed to the port 77 may be provided. Such an additional port is shown in broken lines in FIG. 6. This port 77*a* is shown as terminating a separate signal conduit 71*a* which, at an appropriate position within the casing 2, joins with the conduit 71 so that the ports 77 and 77*a*** are interconnected.

I claim:

1. A hydraulically operated oscillatory device comprising:

a housing defining a cylinder a piston arranged to oscillate in said cylinder, said housing containing a first chamber in which hydraulic pressure acts to displace the piston in a forward stroke direction, said housing also containing a second chamber in which hydraulic pressure operates the piston in a return stroke direction and which is continuously subject to hydraulic working pressure during operation of the device, said housing further containing a third chamber the volume of which increases as said piston moves in said forward stroke direction, a one-way valve connected to exhaust said third chamber, a sequence valve which controls pressurization and exhausting of said first chamber to produce reciprocation of the piston, said sequence valve including a pilot piston, said pilot piston being movable to first and second positions to control the pressurization and exhausting of said first chamber, a plurality of pilot ports positioned in said cylinder so as to be uncovered by the piston at the end of each return stroke to allow a sequence valve actuating flow of hydraulic fluid from said second chamber through at least one of said ports to said pilot piston located at one end of said sequence valve, said fluid forcing said pilot piston from a first position to a second position to thereby cause stroke reversal of said piston, the last port to be uncovered during the return stroke of said piston being directly connected to said sequence valve, and said last port being uncovered at the end of each forward stroke of the piston to connect that port to the third chamber and exhaust said pilot piston, and a valve means connected between each other of said pilot ports and said sequence valve for selectivity and individually rendering operative said separate pilot ports.

2. The device of claim 1 wherein said device is a percussive mechanism, and wherein actuation of the valve means varies the oscillating frequency inversely with percussive power per blow.

3. A hydraulically operated oscillatory device according to claim 2 wherein said pilot ports comprise two separate ports, one of said ports being directly communicated with said sequence valve and wherein said valve means comprises a single on/off valve for controlling the one of said separate pilot ports first uncovered by the piston at the end of a return stroke thereof.

4. A hydraulically operated oscillatory device comprising:

a housing defining a cylinder, a piston arranged to oscillate in said cylinder, said housing containing a first chamber in which said hydraulic pressure intermittently acts to displace the piston in a forward stroke direction, said housing also containing a second chamber in which hydraulic pressure operates the piston in a return stroke direction and which is continuously subject to said hydraulic working pressure during operation of the device, said housing containing a third chamber the volume of which increases as said piston moves in said forward stroke direction, a one-way valve connected to exhaust said third chamber, a sequence valve which controls pressurization and exhausting of said first chamber to produce reciprocation of said piston, said sequence valve including a pilot piston, said pilot piston being biased toward a first position and being movable toward a second position to control the pressurization and exhausting of said first chamber, a plurality of pilot ports positioned in said cylinder so as to be alternately exposed by said piston to allow a sequence valve actuating flow of hydraulic fluid through at least one said pilot ports from said second chamber to said pilot piston, said pilot piston being moved to said second position to thereby cause stroke reversal of said piston at one end of the piston stroke, one of said pilot ports being uncovered by the piston to connect said pilot piston through said one pilot port to said third chamber, said third chamber being at a reduced pressure when said one pilot port is uncovered, and said pilot piston being moved to said first position when said one pilot port is uncovered, said piston effecting stroke reversal at the other end of said piston stroke; and stroke selection means for varying the position of the piston in the cylinder at which the valve actuating flow occurs through said pilot ports to thereby vary the piston stroke length while the position of the piston at which said one pilot port is connected to said third chamber remains constant.

* * * * *